United States Patent [19]

Vedani

[11] 4,030,674

[45] June 21, 1977

[54] DEVICE FOR INCORPORATING AN IDENTIFICATION MARKER IN A ROLL OF TEXTILE SUBSTANCE

[75] Inventor: Augusto Vedani, Turbigo (Milan), Italy

[73] Assignee: Sant'Andrea Novara Officine Meccaniche e Fonderie S.p.A., Novara, Italy

[22] Filed: Apr. 15, 1976

[21] Appl. No.: 677,206

[30] Foreign Application Priority Data

Oct. 3, 1975 Italy ..... 69459/75

[52] U.S. Cl. ..... 242/55; 271/103; 156/DIG. 19

[51] Int. Cl.² ..... B65C 5/00; B65H 75/02

[58] Field of Search ..... 242/54 R, 55, 62; 156/239, 240, 324, 354, 355, DIG. 5–DIG. 40; 271/112, 195, 96–98, 103

[56] References Cited

UNITED STATES PATENTS

| | | | |
|---|---|---|---|
| 2,504,993 | 4/1950 | Lobasso | 156/DIG. 20 |
| 2,528,856 | 11/1950 | Caldwell | 156/DIG. 20 |
| 3,273,885 | 9/1966 | Silver | 271/96 |
| 3,582,065 | 6/1971 | Luginbuhl | 271/98 |

FOREIGN PATENTS OR APPLICATIONS

| | | | |
|---|---|---|---|
| 1,308,842 | 3/1973 | United Kingdom | 242/35.6 E |

*Primary Examiner*—Leonard D. Christian
*Attorney, Agent, or Firm*—Sughrue, Rothwell, Mion, Zinn, & Macpeak

[57] ABSTRACT

An automatic device for incorporating an identification marker in a reel or roll, the device having an applying member for placing a new leading end of a textile substance and also the marker against a rotary roll or reel support member, and marker positioning heads for automatically removing a respective marker from a marker container and positioning the marker on the applying member before the applying member is moved up against the rotary support member.

12 Claims, 4 Drawing Figures

DEVICE FOR INCORPORATING AN IDENTIFICATION MARKER IN A ROLL OF TEXTILE SUBSTANCE

BACKGROUND OF THE INVENTION

The present invention relates to a device for incorporating an identification marker in a reel or roll of a textile substance wound on a rotary support member. The invention has particular, but not exclusive, application to the winding machine or frame of a high draft or attenuation drafting frame, in which a sliver or roving of discontinuous fibres is wound as a strip on a rotary support member (termed a bobbin) in order to form a reel of the silver or roving. However, the invention is also applicable to winding other textile substances on rotary support members, e.g. winding yarn or even winding fabric.

The identification marker itself may be in the form of an elongate, rectangular tag, made of a somewhat stiff material such as cardboard. The markers are used in order to identify the reels or rolls, and present practice is for the operator to hold the marker briefly in position on the rotating rotary support member so that it is bound in by the textile substance, or for the operator to place the marker by hand on a concave-shaped member which may be used to guide the leading end of the textile substance onto a new rotary support member, e.g. as described in British Pat. Specification No. 1,308,842.

Placing the marker onto a rotary support member which is already moving is a hazardous operation, and both alternatives require the presence of the operator.

It is an object of this invention to provide an automatic device for incorporating the marker, in a simple and inexpensive manner.

THE INVENTION

In accordance with the present invention, an automatic device for incorporating the marker comprises a movable applying member for applying the marker to the surface of the rotary support member or of the reel or roll, marker positioning means for positioning the marker on the movable applying member, and an arrangement for coordinating the movement of the marker positioning means with the movement of the applying member.

As disclosed in British Patent Specification No. 1,308,842, the rotary support member may have suction holes in its periphery, suction means being provided for applying suction to the holes at least during the commencement of winding on to the new rotary support member, and these suction holes can be used in a simple and inexpensive manner for retaining the marker on the surface of the rotary support member until the first turns of the textile substance hold the marker firmly in position, and the concave-shaped member which is used to apply the leading end of the textile substance to the rotary support member can be used to apply the marker to the surface of the rotary support member. In this way, no substantial extra cost is incurred in providing the movable applying member of the invention.

BRIEF DESCRIPTION OF THE DRAWINGS

The invention will be further described, by way of example, with reference to the accompanying drawings, in which.

DETAILED DESCRIPTION OF ONE EMBODIMENT OF THE INVENTION

Figure 2:
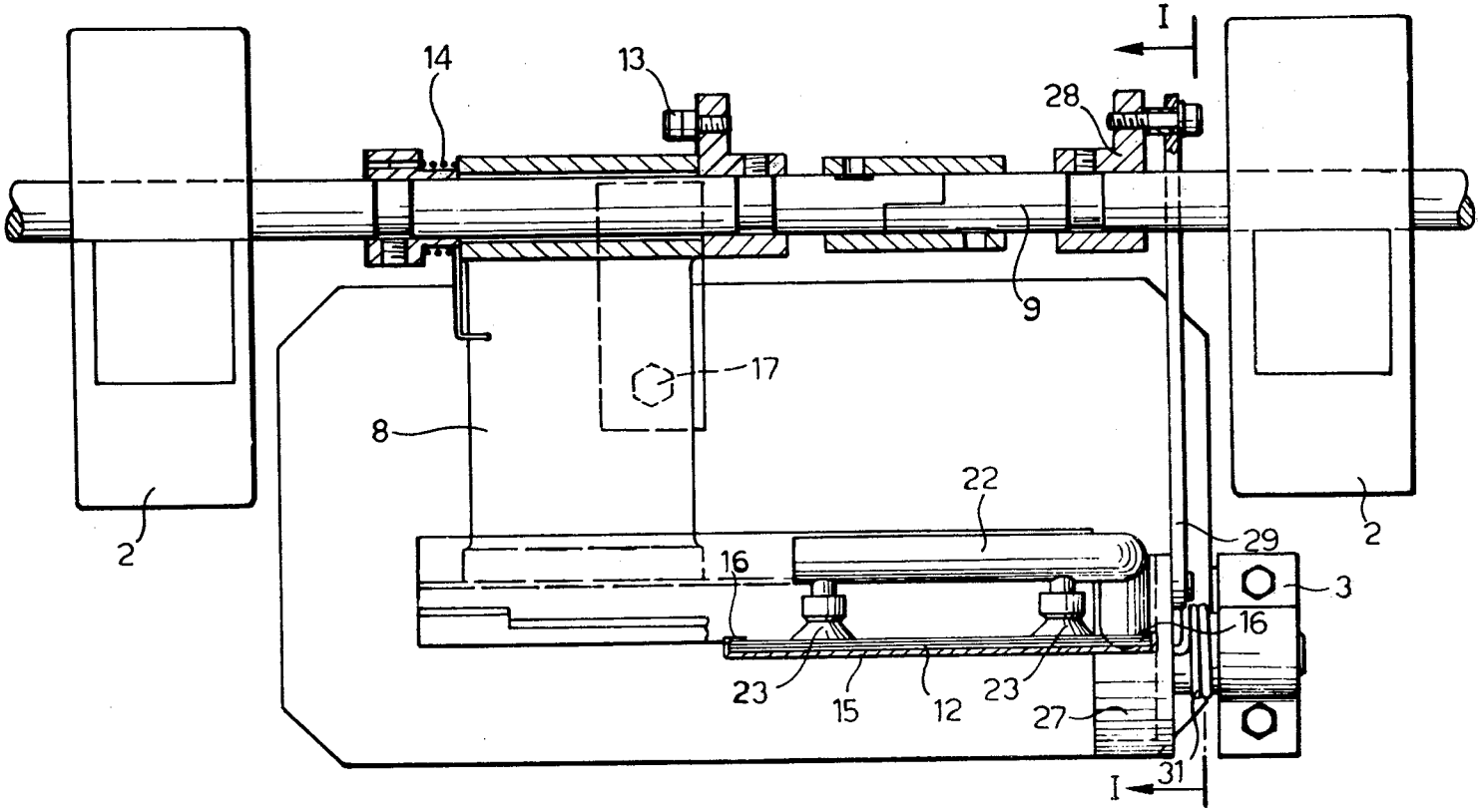
FIG. 2 is an elevation of part of the winding frame, mainly in vertical section along the line II—II of FIG. 1.
Figure 3:
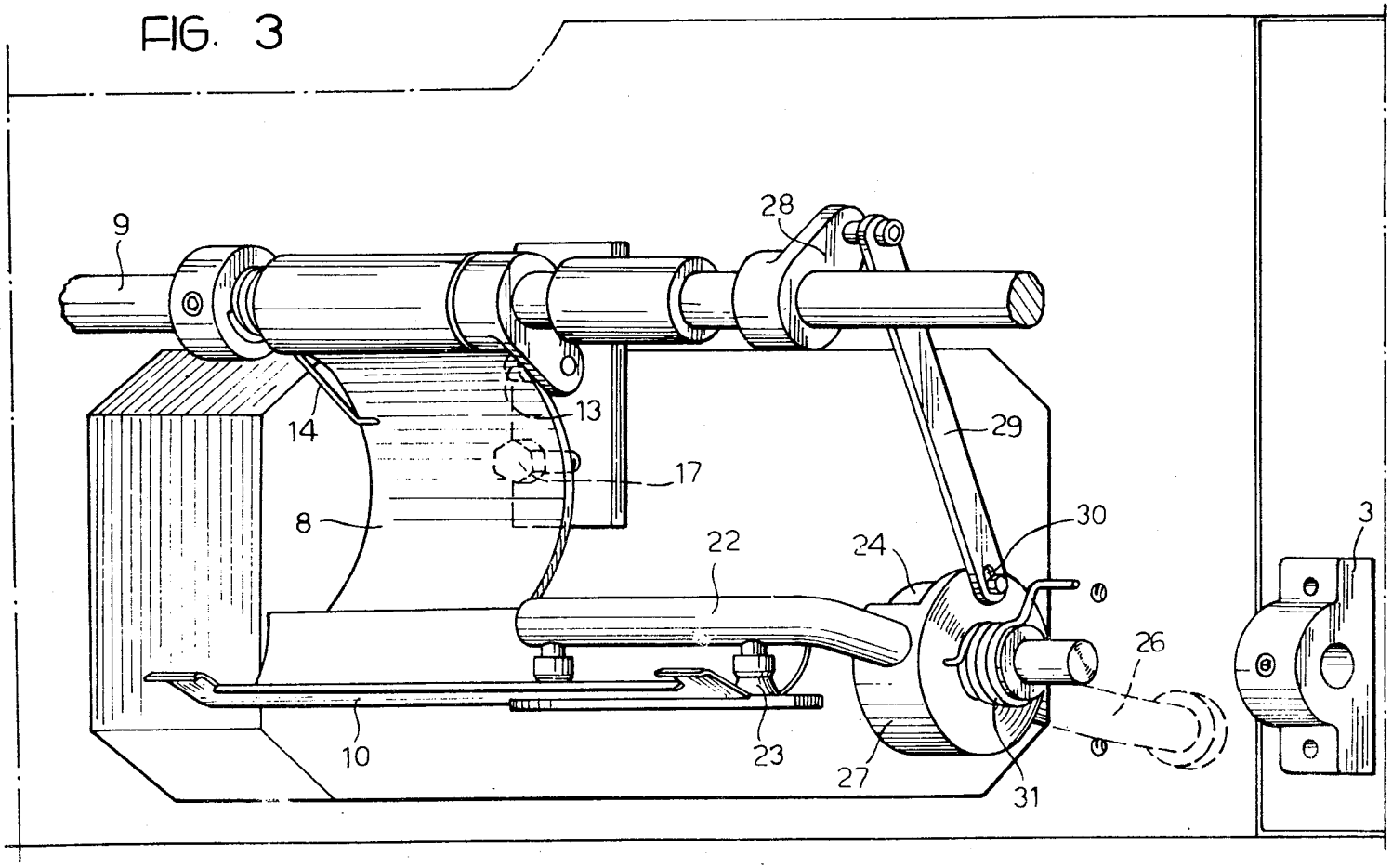
FIG. 3 is a perspective view of part of the automatic device.
Figure 4:
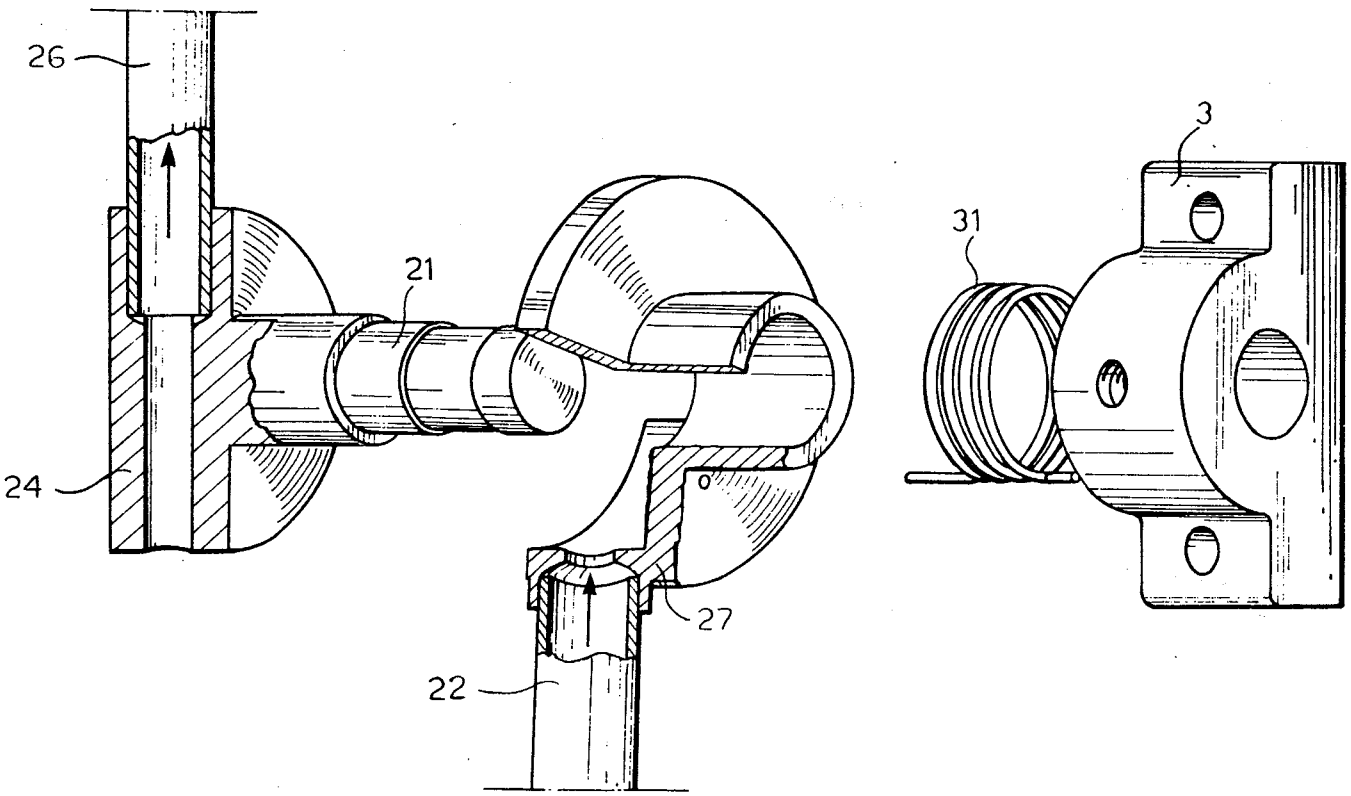
FIG. 4 is an exploded perspective view of part of the device, partly in section along the line IV—IV of FIG. 1, and with the bracket turned around for clarity.

The drawings show a winding frame generally as disclosed in British Patent Specifications No. 1,308,842 and No. 1,320,978, though the sliver may be severed either by cutting as in British Patent Specification No. 1,308,842 or by breakage as disclosed in Italian patent application No. 69458-A/75. The winding frame has stationary support means in the form of a stand 1 to which is secured three brackets 2, 3 and 4. The uppermost brackets 2 carry a powered drive roll 5 which causes the rotary support member or bobbin 6 to rotate as the sliver, coming from a sliver guide 7, is laid to-and-fro along the length of its surfaces; for laying the sliver, the drive roll 5 can be in the form of a traverse roll (with helical grooves) or an oscillating traverse can be provided. The uppermost bracket 2 also carries pivoted, semi-circular first arms 8 whose pivot axis (the axis of drive means in the form of a drive shaft 9) is generally on the opposite side of the drive roll 5 to the bobbin 6. The first pivot arms 8 support a movable applying member or applicator 10 which is in section concave generally towards the axis of the bobbin 6. The applicator 10 serves two functions, that of applying the leading end 11 of the cut or broken sliver against the periphery of the bobbin 6, and that of applying an identification marker 12 which is made of a stiff but somewhat flexible material, to the surface of the bobbin 6, as described in more detail below. The drive shaft 9 is connected to the first pivot arm 8 by means of a drive abutment 13 (see FIGS. 2 and 3) against which the first pivot arm 8 is biased by means of a helical torsion spring 14.

The applicator 10 mounts a cuboidal container 15 which is just slightly wider and longer than a marker 12 and which can hold a plurality of the markers 12. The container 15 has an opening (see FIG. 2) which faces upwards when the applicator 10 is in its substantially horizontal position shown in full lines in FIG. 1, which opening has at least one dimension, in this case its length, which is smaller than the corresponding dimension of the container 15, the two respective opposite sides of the opening being defined by two short lips 16 on the container 15. In this way, the markers 12 are already carried by the applicator 10, though not in a suitable position for application to the bobbin 6, and an operator can reload the container 15 when it is empty or nearly empty. The container 15 can be arranged for reloading in any suitable manner.

Figure 1:
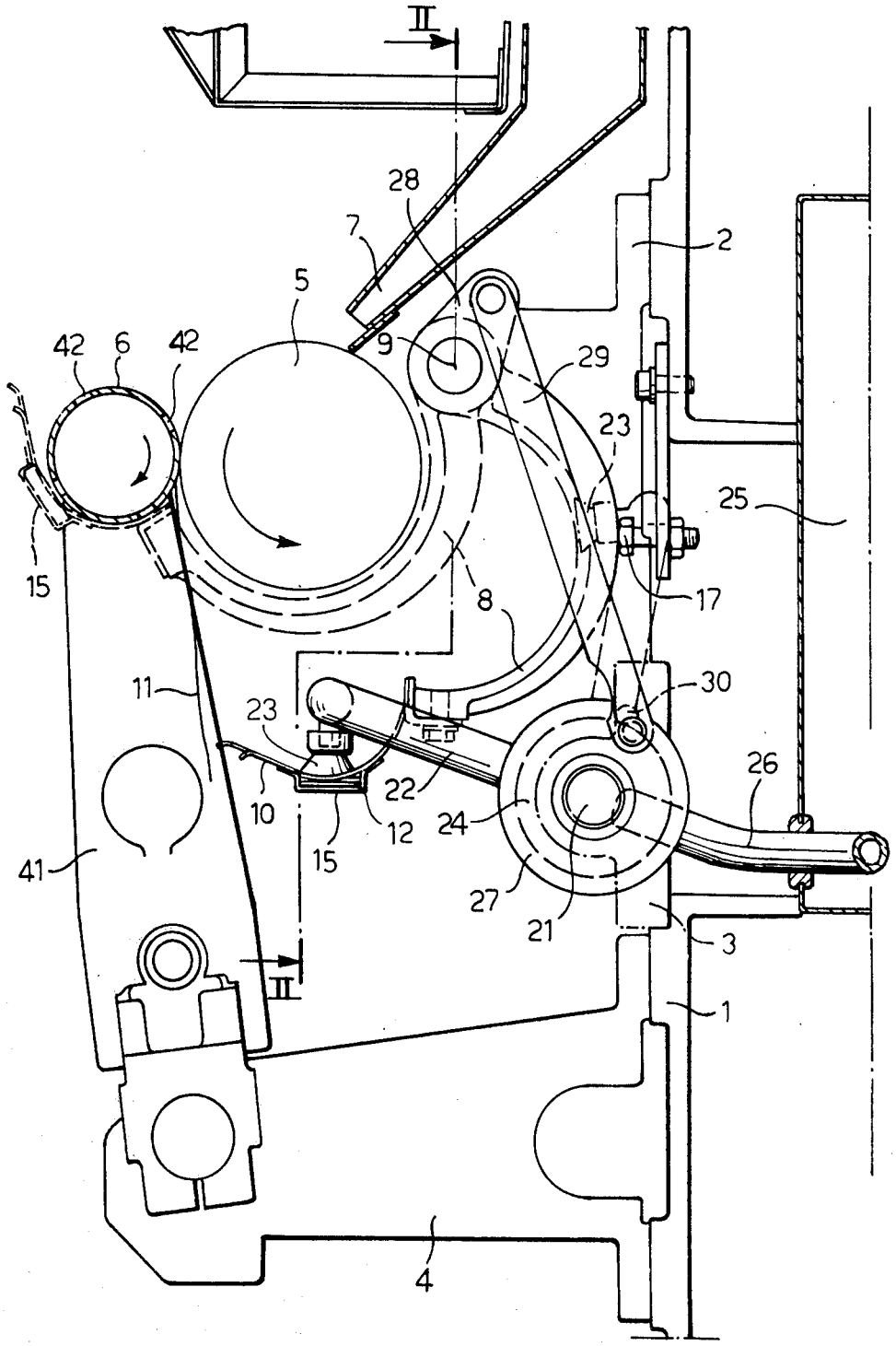
FIG. 1 is a side view, partly in section along the line I—I of FIG. 2, of part of a winding frame which includes an automatic identification marker incorporating device in accordance with the invention.

A back-stop 17 is provided for stopping the first pivot arm 8 in the position shown in full lines in FIG. 1, the arm 8 in effect being held against the back-stop 17 by the helical spring 14.

The middle bracket 3 mounts a fixed spindle 21 which acts as the pivot axis for a second hollow pivot arm 22, the pivot axis thereby being below that of the first pivot arm 8 and also generally on the opposite side of the drive roll 5 to the bobbin 6. The second pivot arm 22 carries marker positioning means in the form of at least one suction head 23; normally, there would be two spaced suction heads 23, but the number of such heads 23 will depend upon the size and shape of the marker 12. The suction heads 23 are fixed to the end of the pivot arm 22, which itself is of L-shape.

The middle bracket 3 also carries a rotary suction control valve which is formed by a stationary valve member 24 connected to a suction reservoir 25 by means of a suction pipe 26, and a cooperating rotary valve member 27 which mounts the second pivot arm 22 and is in communication with the suction heads 23 by means of the interior of the pivot arm 22. The suction control valve 24, 27 is thus operated by movement of the second pivot arm 22, and the arrangement is such that the suction is cut off when the suction heads 23 are moving upwards and are a short distance above the container 15.

The suction heads 23 are mechanically linked to the applicator 10 in such a way that the movement which the applicator 10 executes to position the marker 12 on the bobbin 6 initially causes the suction head 23 to position the marker 12 on the applicator 10, i.e. before the applicator 10 reaches the bobbin 6, thereby coordinating the movements of the suction heads 23 and applicator 10. The mechanical linkage or coordinating means is effected by means of a short lever member 28 which is fixed to the drive shaft 9 and a connecting rod 29 which is pivotally connected between the lever member 28 and a second lever member which is formed by the rotary valve member 27. A small amount of lost motion is incorporated in the drive means of the suction heads 23 by forming the connecting rod 29 with a somewhat elongated slot 30 for its pivotal connection with the roatary valve member 27, and a helical torsion spring 31 (see FIG. 3) is positioned between the bracket 3 and the rotary valve member 27 to bias the suction heads 23 downwards, i.e. towards the applicator 10, and thus to take up the lost motion. This provides a safety feature and also enables the device to continue to operate efficiently as the small stack of markers 12 decreases in height.

FIG. 1 shows the applicator 10 in a rest position which it occupies during the operation of winding the sliver onto the bobbin 6, the rest position being below the drive roll 5. In this rest position, the suction heads 23 are within the container 15 and are in contact with the topmost marker 12. When the drive shaft 9 is actuated by a mechanism (not shown) to swing the applicator 10 against the surface of the bobbin 6, the suction heads 23 swing upwards and draw the top marker 12, which is slightly longer than the opening of the container 15, up through the opening against the slight resistance imposed by the lips 16. When the marker 12 is wholly above the opening, the suction valve 25, 27 operates to cut off the suction to the suction heads 23 and the suction heads 23 drop the marker 12, thereby positioning the marker 12 on the applicator 10 with no positive retention of the marker 12.

Subsequently, as the applicator 10 continues to swing towards the bobbin 6, the suction heads 23 pivot back towards the opposite side of the drive roll 5 to the bobbin 6, finishing their movement in the position indicated with dot-dash lines in FIG. 1.

The lowermost brackets 4 support bobbin-carrying arms or forks 41 which may be generally as described in British Patent Specification No. 1320978. The bobbin 6 has holes 42 in its periphery, and suction means are provided for applying suction to the holes. The suction means may be as described in British Patent Specification No. 1,308,842. In general, the bobbin 6 can be connected to the suction reservoir 25, and a suction valve (not shown) can be incorporated for applying suction to the suction holes 42 only during the beginning of winding. The suction holes 42 pick up and retain the marker 12 applied by the applicator 10, as well as picking up the leading end 11 of the cut or broken sliver. There will be sliding motion of the periphery of the bobbin 6 over the marker 12 so that it does not matter if in the initial position of the marker 12 on the bobbin 6, the marker 12 does not cover one of the holes 42.

We claim:

1. An automatic device for incorporating an identification marker in a reel or roll of a textile substance wound on a rotary support member, the device comprising:

stationary support means;

a container for holding a plurality of the markers;

an applying member for placing a new leading end of the textile substance against the rotary support member, for commencing winding, the applying member being movably mounted on the support means;

a marker positioning means for automatically removing a respective marker from the marker container and positioning the marker on the applying member, the marker positioning means being movably mounted on the support means;

drive means for actuating the marker positioning means to position the marker on the applying member;

drive means for actuating the applying member to place the textile substance leading end and the marker against the rotary support member; and coordinating means coordinating the actuation of the marker positioning means drive means and the applying member drive means, whereby the marker positioning means positions the marker on the applying member before the applying member reaches the rotary support member and places the textile substance leading end and marker against the rotary support means.

2. The automatic device of claim 1 wherein the marker positioning means comprises at least one suction head for engaging the marker and positioning the marker on the movable applying member.

3. The automatic device of claim 2, wherein the rotary support member has suction holes in its periphery, suction means being provided for applying suction to the holes, at least during the commencement of winding onto a new rotary support member, and the at least one suction head of the marker positioning means being connected to the same suction means.

4. The automatic device of claim 2 wherein the marker positioning means occupies a rest position during the operation of winding the textile substance on the rotary support member, in which rest position the at least one suction head is in contact with the next marker to be placed against the rotary support member.

5. The automatic device of claim 1, wherein the marker container is mounted on the movable applying member.

6. The automatic device of claim 5, wherein the marker container defines an opening which faces upwards when the movable applying member is in a substantially horizontal position, which opening has at least one dimension which is smaller than the corresponding dimension of the container, whereby the container can hold markers which have a corresponding dimension slightly greater than that of the opening, the marker positioning means comprising at least one suction head for drawing the respective marker up through the opening against the slight resistance imposed by the engagement of the edges of the opening with the marker, and placing the marker down over the opening.

7. The automatic device of claim 6 including a pivoted arm and wherein the at least one suction head is carried on said pivoted arm and a rotary suction control valve coaxial with the pivoted arm is operated by movement of the pivoted arm, the valve cutting off suction to the suction head when the at least one suction head is a short distance above the marker container.

8. The automatic device of claim 1, wherein the movable applying member is pivotally mounted about a first axis, the marker positioning means is pivotally mounted about a second axis parallel to said first axis, a first lever member is connected to the movable applying member, a second lever member is connected to the marker positioning means, and a connecting rod interconnects the first and second lever members.

9. The automatic device of claim 1, wherein there is a small amount of lost motion in the drive means of the marker positioning means and at least one spring is incorporated to bias the marker positioning means in the direction towards the movable applying member, to take up the lost motion.

10. A textile winding machine comprising:

stationary support means;

a rotary support member rotatably mounted on the support means for winding a textile substance on the rotary support member to form a reel or roll;

a drive roll for driving the periphery of the periphery of the rotary support member, reel or roll, the drive roll being rotatably mounted on the support means;

a container for holding a plurality of markers;

an applying member for placing a new leading end of the textile substance against the rotary support member, for commencing winding, the applying member being movably mounted on the support means;

a marker positioning means for automatically removing a respective marker from the marker container and positioning the marker on the applying member, the marker positioning means being movably mounted on the support means;

drive means for actuating the marker positioning means to position the marker on the applying member;

drive means for actuating the applying member to place the textile substance leading end and the marker against the rotary support member; and coordinating means coordinating the actuation of the marker positioning means drive means and the applying member drive means, whereby the marker positioning means positions the marker on the applying member before the applying member reaches the rotary support member and places the textile substance leading end and marker against the rotary support means, and whereby the identification marker is incorporated in the reel or roll wound on the rotary support member.

11. The textile winding machine of claim 10, wherein a first pivoted arm is pivotally mounted on the support means for pivotal movement about a pivot axis generally on the opposite side of the drive roll to the rotary support member.

12. The textile winding machine of claim 11, wherein a second pivoted arm is pivotally mounted on the support means for pivotal movement about a pivot axis below that of the first pivoted arm and also generally on the opposite side of the drive roll to the rotary support member, the drive means of the movable applying member permitting the movable applying member to occupy a rest position during the operation of winding the textile substance on the rotary support member which rest position is below the drive roll, and the drive means of the marker positioning means pivoting the marker positioning means back towards the opposite side the drive roll to the rotary support member as the drive means of the movable applying member moves the movable applying member up towards the rotary support member to apply a marker to the rotary support member.

* * * * *